US006805573B2

(12) United States Patent
Phillips et al.

(10) Patent No.: US 6,805,573 B2
(45) Date of Patent: Oct. 19, 2004

(54) CONNECTOR MODULE WITH LEVER ACTUATED RELEASE MECHANISM

(75) Inventors: Michael J. Phillips, Camp Hill, PA (US); Michael E. Shirk, Grantville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 208 days.

(21) Appl. No.: 10/308,743

(22) Filed: Dec. 4, 2002

(65) Prior Publication Data

US 2004/0110406 A1 Jun. 10, 2004

(51) Int. Cl.[7] ..... H01R 13/627
(52) U.S. Cl. ..... 439/352; 439/157; 439/160
(58) Field of Search ..... 439/350, 351–358, 439/160, 157, 152, 155

(56) References Cited

U.S. PATENT DOCUMENTS 5,571,023 A * 11/1996 Anthony ..... 439/142
5,810,612 A * 9/1998 Flask et al. ..... 439/157
6,019,618 A * 2/2000 Nakata ..... 439/157
6,213,795 B1 * 4/2001 Drescher et al. ..... 439/157
6,371,787 B1 4/2002 Branch et al. ..... 439/352
6,430,053 B1 8/2002 Peterson et al. ..... 361/728
6,434,015 B1 * 8/2002 Hwang ..... 361/754
6,439,918 B1 * 8/2002 Togami et al. ..... 439/372
6,612,858 B1 * 9/2003 Stockhaus ..... 439/352
6,705,764 B2 * 3/2004 Shang ..... 385/53

* cited by examiner

*Primary Examiner*—Tho D. Ta
*Assistant Examiner*—X. Chung-Trans

(57) ABSTRACT

A small footprint plugable (SFP) connector module is provided having a housing carrying contacts at a lead end that are configured to be inserted into a cage. The housing has a rear end configured to be connected to a cable. The housing has a wall with a module latch formed thereon. The module latch is configured to engage a cage latch on a cage. The connector module also includes a lever beam slidably mounted to the wall of the housing. The lever beam is movable to a position proximate the module latch to release the module latch from the cage latch. The connector module also includes a lever arm rotatably mounted to the housing. The lever arm drives the lever beam to the position porximate the module latch when the lever arm is rotated.

20 Claims, 8 Drawing Sheets

CONNECTOR MODULE WITH LEVER ACTUATED RELEASE MECHANISM

BACKGROUND OF THE INVENTION

The present invention generally relates to a connector module. More particularly, the present invention relates to a connector module with a lever-activated release mechanism that ejects a connector module from a connector cage.

Conventional connector cages are box-shaped and have flexible prongs along a bottom wall that are received in apertures in a circuit board to retain the connector cage thereto. The connector cage also has contact pins that engage electrical traces or contacts on the circuit board. The connector cage has an open end that receives a box-shaped connector module carrying electronic components such as a transmitter or receiver. When the connector module is fully inserted into the connector cage, one end of the connector module extends from the connector cage. The components within the connector module are connected to the contact pins on the connector cage and to an electrical cable that extends from the exposed end of the connector module to join with another component. Thus, when the connector module is fully inserted into the connector cage, the electronic components within the connector module are connected to the circuit board and a remote component.

Conventional connector modules have a locking tab extending from a bottom wall thereof. When a connector module is slid into the connector cage, the locking tab slides under a retention spring that extends from a bottom wall of the connector cage. The locking tab is received in a gap in the retention spring to retain the connector module within the connector cage.

The connector module also has a release mechanism that is slidably retained by rails on the bottom wall near the exposed end of the connector module. The release mechanism has a ramp with an inclined surface facing the tab and retention spring at one end and a flat rectangular rear wall at an opposite end. The rear wall extends out from beneath the bottom wall of the connector module at the exposed end and serves as a button. In operation, the rear wall, or button, is pushed inward toward the retention spring such that the inclined surface of the ramp slides partially under the retention spring and pushes the retention spring out away from the bottom wall of the connector cage. When the retention spring is moved to a point such that the locking tab is no longer received within the gap, the connector module is then pulled outward away from the retention spring and out of the connector cage.

However, conventional connector modules suffer from several drawbacks. First, users may inadvertently push the button that releases the module when not intending to do so. Inadvertently disengaging the connector module may shut down the operation of the computer or cause other electronic complications. Second, users do not find it intuitive to press the button in a first direction and pull the module in an opposite direction to remove the module. Thus, for an operator trying to disengage the connector module, the release mechanism is counter-intuitive. Further, users may not realize the button must be pressed to remove the module. This confusion lends users to attempt to pull the module from the cage without first pushing the button, thereby potentially damaging the module and/or cage. Hence, the counter-intuitive nature of the button leads operators to damage the connector module in an effort to force the release of the connector module in some other inappropriate manner besides pushing the button inward.

A need remains for a connector module with a release mechanism that overcomes the above problems and addresses other concerns experienced heretofore.

BRIEF SUMMARY OF THE INVENTION

Certain embodiments of the present invention include a small footprint plugable (SFP) connector module having a housing carrying contacts at a lead end that are configured to be inserted into a cage. The housing has a rear end configured to be connected to a cable. The housing has a wall with a module latch formed thereon. The module latch is configured to engage a cage latch on a connector cage. The connector module also includes a lever beam slidably mounted to the wall of the housing. The lever beam is movable to a position proximate the module latch to release the module latch from the cage latch. The connector module also includes a lever arm rotatably mounted to the housing. The lever arm drives the lever beam to the position proximate the module latch when the lever arm is rotated.

The lever arm has a pair of arms pivotally mounted at intermediate points along the arms to opposite sides of the housing. The arms have upper ends joined by a crossbeam and lower ends connected to the lever beam. The lever beam includes an engagement block having cam ears extending from at least one side thereof. The cam ears receive therebetween the lever arm. The lever beam includes a ramp portion having a sloped surface configured to be slid between the wall of the housing and the cage latch to separate the cage and module latches. The actuation lever includes driving arms and the first housing has guide channels. The driving arms are received and rotatable in the guide channels.

Figure 1:
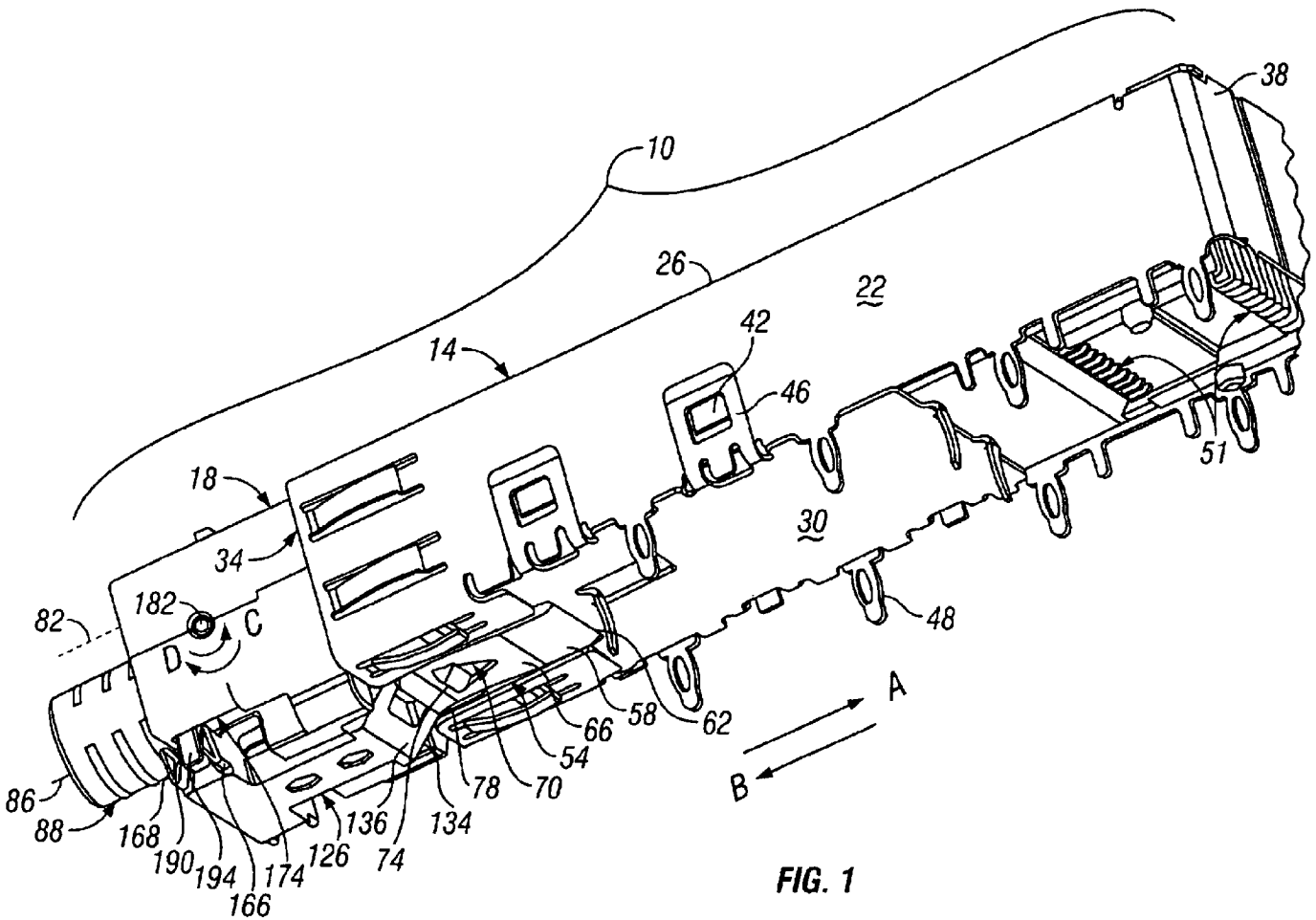
FIG. 1 illustrates a partial bottom isometric view of an electrical connector assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a partial bottom isometric view of an electrical connector assembly 10. The connector assembly 10 has a metal connector cage 14 receiving a small footprint plugable (SFP) connector module 18. The connector module 18 carries electronic components such as a transmitter and a receiver that are connected to electrical contacts 51 on the connector module 18 and a remote component (not shown) by a cable 86 extending from the connector module 18 through a cylindrical cable carrier 88. The connector cage 14 is box shaped and defined by parallel side walls 22 formed with a top wall 26. The side walls 22 have latch arms 42 extending from a bottom wall 30 that receive latch projections 46. The bottom wall 30 is thus fastened to the side walls 22 and held parallel to the top wall 26. The side walls 22 also have flexible prongs 48 extending downward therefrom. In operation, the connector cage 14 is mounted to a printed circuit board (not shown) by interference fitting the flexible prongs 48 into apertures in the printed circuit board.

The connector cage 14 has an open end 34 opposite a rear wall 38. The open end 34 removably receives the connector module 18 when the connector cage 14 is securely mounted to the printed circuit board. Inside the connector cage 14 a biasing component such as a flexible plate extends from the rear wall 38 toward the open end 34. The biasing component resistibly engages the connector module 18 when the connector module 18 is inserted into the connector cage 14 through the open end 34 in the direction of arrow A.

The bottom wall 30 of the connector cage 14 has a thin metal retention spring 54. The retention spring 54 is flexible and has a flat plate portion 58 that extends out of, and is resistibly retained in, a slit 62 in the bottom wall 30 and that is generally parallel with the bottom wall 30. The plate portion 58 is formed with a flat catch plate 66 that extends from the plate portion 58 at an obtuse angle toward the connector module 18. The catch plate 66 has a triangular gap 70 that receives a triangular locking tab 74 extending downward from the connector module 18. The catch plate 66 is in turn formed with a flat guide plate 78 that extends from the catch plate 66 at an obtuse angle away from the connector module 18.

In operation, when the connector module 18 is slidably inserted into the connector cage 14 in the direction of arrow A, the locking tab 74 slides against and under the guide plate 78 and pushes the guide plate 78, and thus the entire retention spring 54, out away from the connector module 18. As the locking tab 74 slides into, and is secured within, the gap 70 of the catch plate 66, the biasing component in the connector cage 14 resists the connector module 18 such that the connector module 18 is limited in axial movement along a longitudinal axis 82. The connector module 18 is thus fully connected to the connector cage 14.

When the connector module 18 is fully inserted into the connector cage 14, the electrical contacts 51 of the connector module 18 engage contact pads or traces on the printed circuit board to electrically connect the cable 86 and the printed circuit board.

Figure 2:
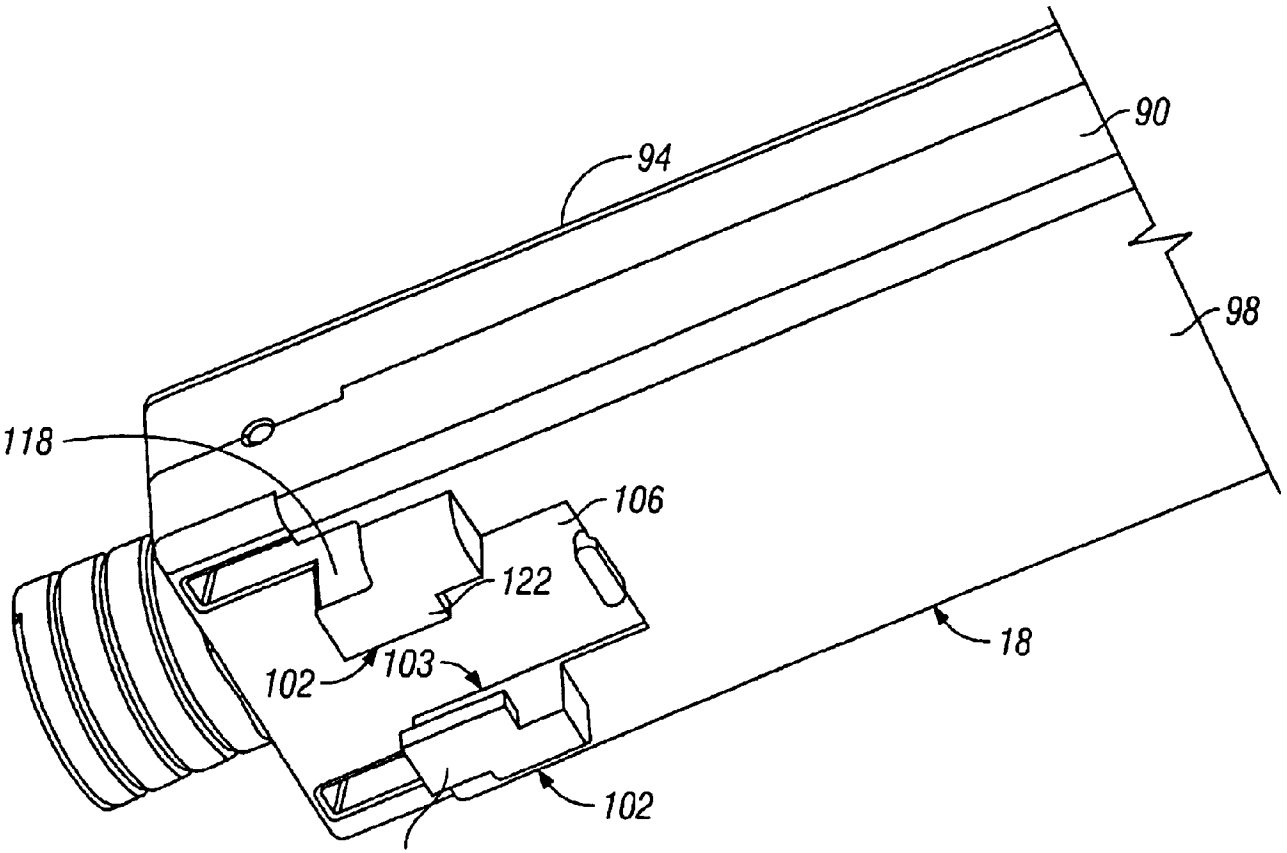
FIG. 2 illustrates a partial bottom isometric view of the connector module formed in accordance with an embodiment of the present invention.

FIG. 2 illustrates a partial bottom isometric view of the connector module 18 formed in accordance with an embodiment of the present invention. The connector module 18 has parallel side walls 90 formed with parallel top and bottom walls 94 and 98. Retention shoulders 102 are formed with, and extend downward from, the bottom wall 98 and are aligned parallel to each other. The retention shoulders 102 have side walls 118 formed with, and oriented perpendicular to, rail walls 122. A recessed surface 106 extends along the bottom wall 98 between the retention shoulders 102. The rail walls 122 extend parallel to the recessed surface 106 to define gaps 103 therebetween. The retention shoulders 102 retain a ramp beam 126 (FIG. 3) along the recessed surface 106 of the connector module 18.

Figure 3:
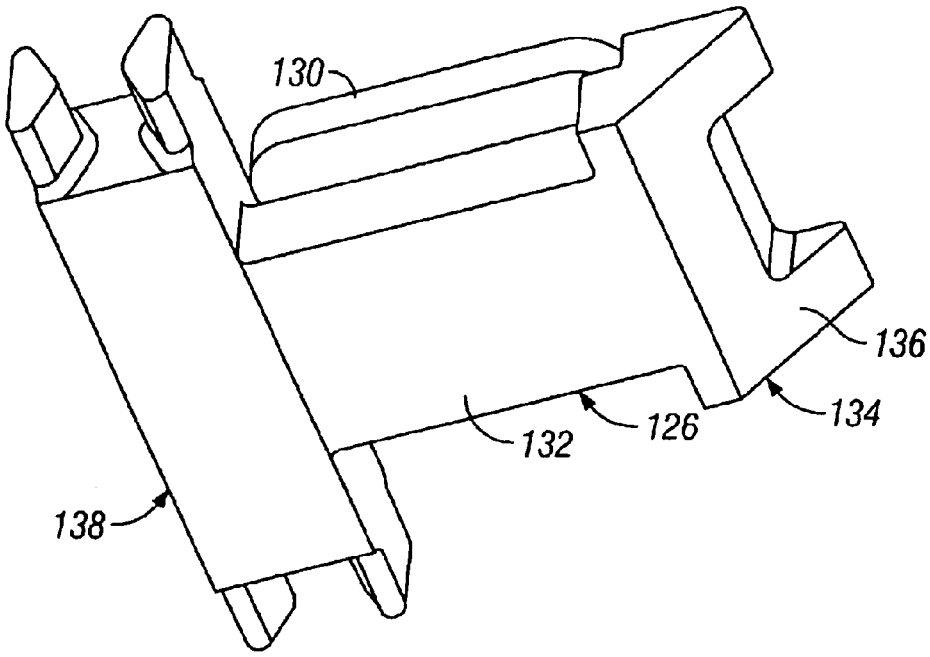
FIG. 3 illustrates an isometric view of a ramp beam formed according to an embodiment of the present invention.

FIG. 3 illustrates an isometric view of the ramp beam 126 formed according to an embodiment of the present invention. The ramp beam 126 has a rectangular center beam 132 formed with a ramp 134 at the front end and a rectangular lever engagement block 138 at the rear end to form an I shape. The ramp 134 has an inclined engagement surface 136. Planar rails 130 are formed along the center beam 132 between the ramp 134 and the engagement block 138.

Figure 4:
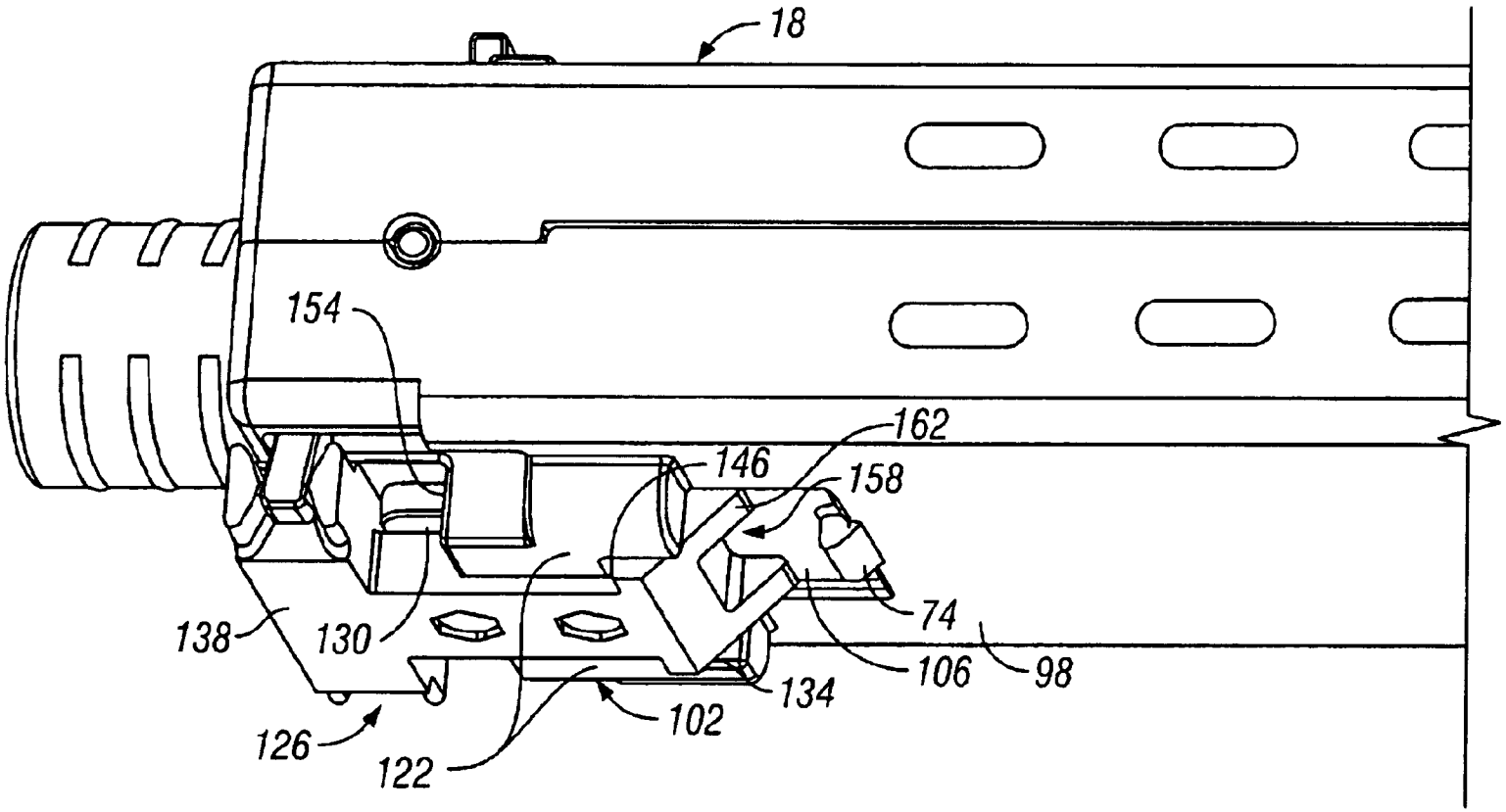
FIG. 4 illustrates a partial bottom isometric view of the connector module formed according to an embodiment of the present invention.

FIG. 4 illustrates a partial bottom isometric view of the connector module 18 formed according to an embodiment of the present invention. The retention shoulders 102 slidably receive the rails 130, and thus the ramp beam 126, within the gaps 103 (FIG. 2) between the rail walls 122 and the recessed surface 106. The rail walls 122 have L-shaped cutouts that afford the rails 130 a clearance to slide along the rail walls 122 in the directions of arrows A and B. As shown in FIG. 4, the ramp beam 126 is slid in the direction of arrow B such that the ramp 134 engages ramp contact surfaces 146 of the rail walls 122. Alternatively, the ramp beam 126 may be slid in the direction of arrow A such that a lever engagement block 138 engages block contact surfaces 154 of the rail walls 122.

The locking tab 74 extends out from an end of the recessed surface 106 where the recessed surface 106 meets the bottom wall 98. The ramp 134 includes a tab gap 158 defined by two prongs 162 that receives the locking tab 74 when the ramp beam 126 is in an engagement position. The ramp beam 126 is in the engagement position when fully slid in the direction of arrow A until the prongs 162 on the ramp 134 engage the bottom wall 98.

Figure 5:
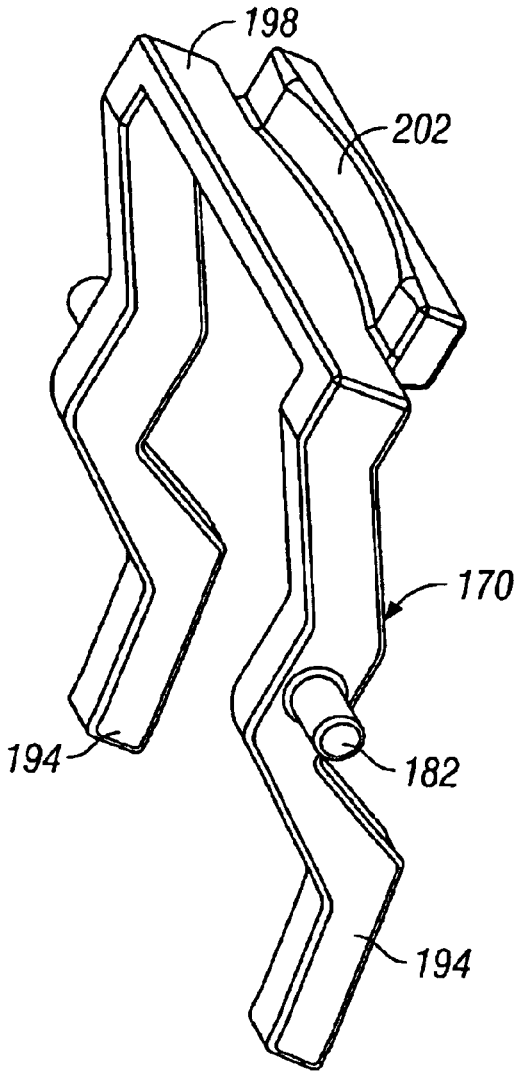
FIG. 5 illustrates an isometric view of an lever beam that is mounted to the connector module.

FIG. 5 illustrates an isometric view of a lever beam 170 that is mounted to the connector module 18 (FIG. 4). Driver arms 194 are formed with, and extend parallel from, a cross beam 198 to define a U-shape. The crossbeam 198 includes an ergonomic thumb groove 202 to allow an operator to easily manipulate the lever beam 170. Cylindrical posts 182 extend out from the driver arms 194 away from each other.

Figure 6:
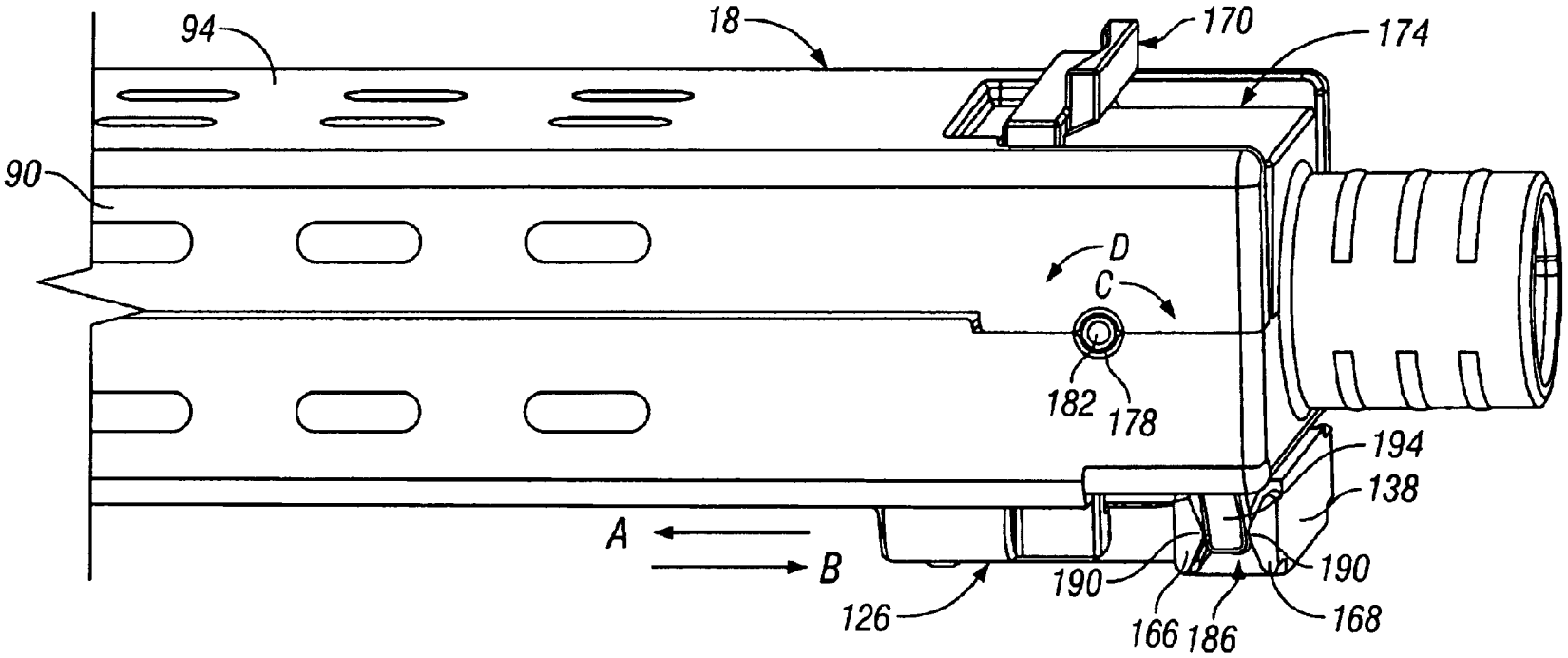
FIG. 6 illustrates a partial top isometric view of the connector module formed in accordance with an embodiment of the present invention.

FIG. 6 illustrates a partial top isometric view of the connector module 18 formed in accordance with an embodiment of the present invention. The rear portion of the top wall 94 includes cut-outs that form guide channels 174. The connector module 18 carries the lever beam 170 in the guide channels 174 between the side walls 90. The side walls 90 have post holes 178 that rotatably support the posts 182 of the lever beam 170.

The lever engagement block 138 has first and second triangular cam ears 166 and 168 on opposite ends thereof. The first and second cam ears 166 and 168 on each end of the lever engagement block 138 are separated by a lever gap 186 and have contact tips 190 extending toward each other. The lever gaps 186 each receive a driver arm 194 extending out of a guide channel 174. When the lever beam 170 is rotated about the posts 182 in the direction of arrow C, the driver arms 194 engage the contact tips 190 of the first cam ears 166 and slidably drive the ramp beam 126 in the direction of arrow A. Alternatively, when the lever beam 170 is rotated about the posts 182 in the direction of arrow D, the driver arm 194 engages the contact tips 190 of the second cam ears 168 and slidably drives the ramp beam 126 in the direction of arrow B.

Figure 7:
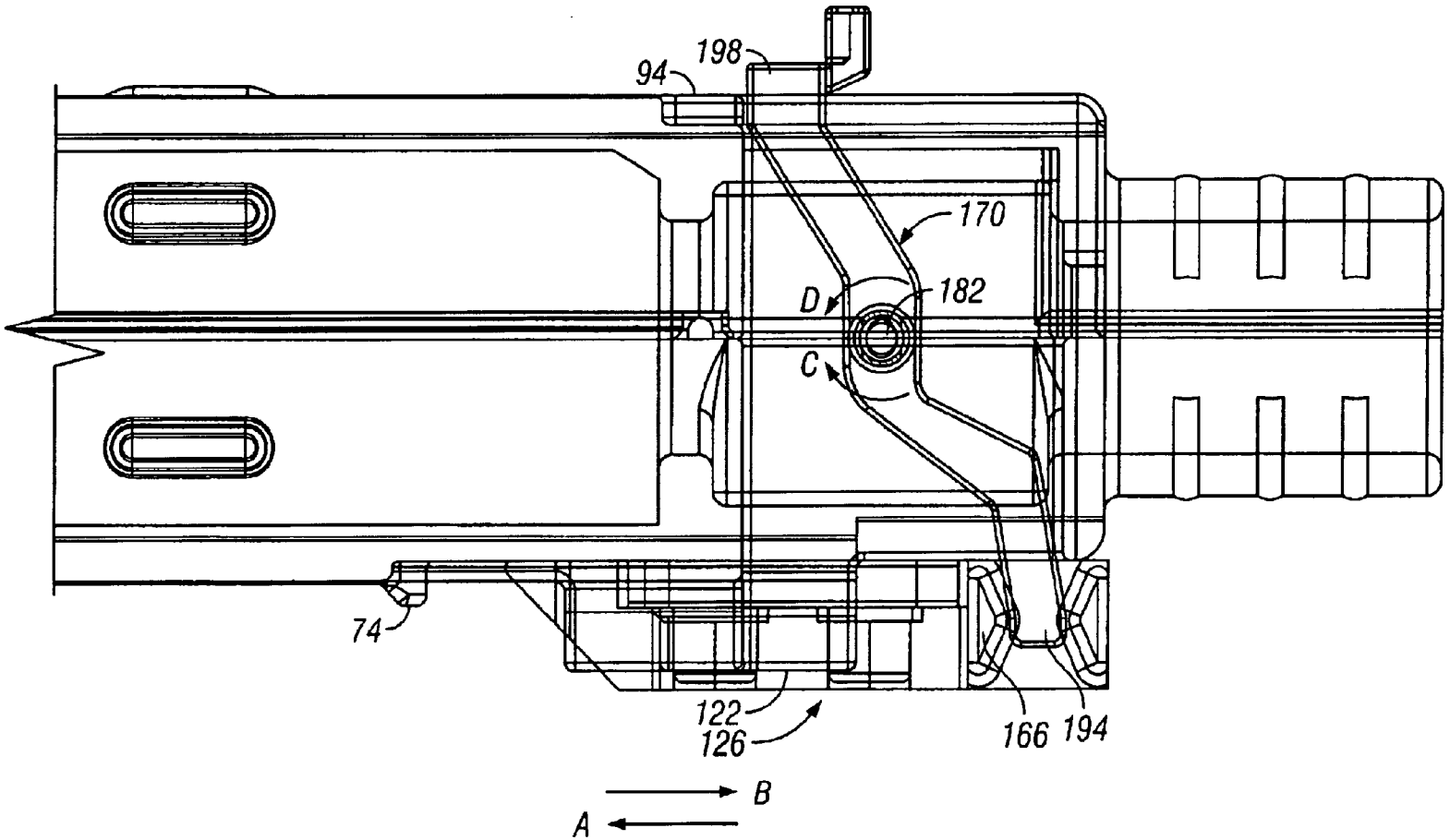
FIG. 7 illustrates a partial side cutaway view of the connector module with the driver arms retaining the ramp beam away from the locking tab.

FIG. 7 illustrates a partial side cutaway view of the connector module 18 with the driver arms 194 retaining the ramp beam 126 away from the locking tab 74. The lever beam 170 is thus in a locked forward position. The crossbeam 198 engages an edge of the top wall 94, which prevents the lever beam 170 from rotating any further in the direction of arrow D. Thus, the driver arms 194 engage the first cam ears 166 to prevent the ramp beam 126 from sliding further in the direction of arrow B off the rail walls 122. To slide the ramp beam 126 toward the locking tab 74, an operator moves the crossbeam 198 of the lever beam 170 in the direction of arrow B such that the driver arms 194 rotate about the posts 182 in the direction of arrow C and push the first cam ears 166 in the direction of arrow A.

Figure 8:
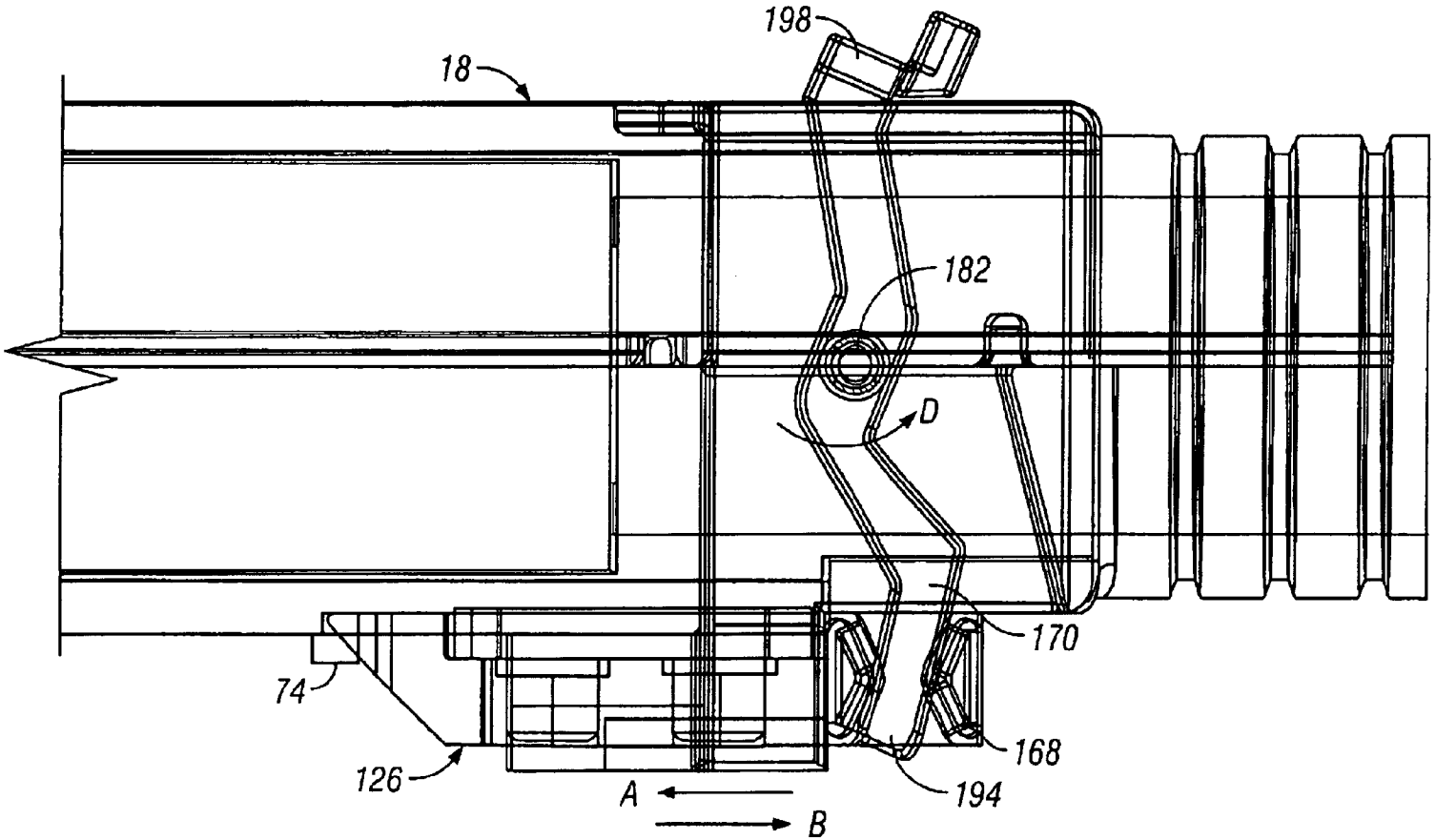
FIG. 8 illustrates a partial side cutaway view of the connector module with the driver arms retaining the ramp beam about the locking tab.

FIG. 8 illustrates a partial side cutaway view of the connector module 18 with the driver arms 194 retaining the ramp beam 126 about the locking tab 74. The lever beam 170 is thus in an engagement position. To slide the ramp beam 126 away from the locking tab 74, an operator moves the crossbeam 198 of the lever beam 170 in the direction of arrow A such that the driver arms 194 rotate about the posts 182 in the direction of arrow D and push the second cam ears 168 in the direction of arrow B.

Returning to FIG. 1, the ramp beam 126 is in the forward position and the locking tab 74 is secured in the gap 70 of the retention spring 54. In operation, the connector module 18 is released from the connector cage 14 by rotating the driver arms 194 about the posts 182 in the direction of arrow C. The driver arms 194 engage the first cam ears 166 and slidably push the ramp beam 126 in the direction of arrow A. As the ramp beam 126 slides in the direction of arrow A, the inclined engagement surface 136 of the ramp 134 engages the guide plate 78 of the retention spring 54 and pushes the guide plate 78 outward away from the recessed surface 106 (FIG. 2) of the connector module 18. The guide channels 174 support the driver arms 194 and prevent the driver arms 194 from being twisted or flexed as the ramp 134 engages the retention spring 54. The ramp beam 126 continues in the direction of arrow A and engages the catch plate 66 of the retention spring 54. The ramp beam 126 pushes the catch plate 66 out away from the recessed surface 106 (FIG. 2) of the connector module 18 until the locking tab 74 is no longer retained in the gap 70 of the catch plate 66. The connector module 18 may then be slid out of the connector cage 14 in the direction of arrow B and disconnected from the connector cage 14.

Alternatively, to insert the connector module 18 back into the connector cage 14, the driver arms 194 are rotated about the posts 182 in the direction of arrow D until the driver arms 194 engage the contact tips 190 of the second cam ears 168 and slidably push the ramp beam 126 in the direction of arrow B to the forward position. The connector module 18 may then be slid in the direction of arrow A into the connector cage 14 during which the locking tab 74 slides under the guide plate 78 and is received in the gap 70 in the catch plate 66 of the retention spring 54.

The connector module provides several benefits over the prior art. Because the connector module uses a lever beam that is rotated away from the connector cage to disengage the connector module, the connector module is easier for an operator to disengage from the connector cage. Manipulating a release mechanism in the same direction as the direction of the connector module's release is more intuitive for an operator. Thus, by having to intuitively rotate the lever beam away from the connector cage to disengage the connector module, an operator is less likely to inadvertently disengage the connector module or damage the connector module or the release mechanism while trying to release the connector module.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A small footprint pluggable (SFP) connector module, comprising:

a housing carrying contacts at a lead end that are configured to be inserted into a cage, said housing having a rear end configured to be connected to a cable, said housing having a bottom wall with a module latch formed thereon, said module latch being configured to engage a cage latch on said cage;

a ramp beam slidably mounted to said wall of said housing, said ramp beam being movable to a position proximate said module latch to release said module latch from the cage latch; and a lever arm rotatably mounted to a longitudinal side wall of said housing, said lever arm driving said ramp beam to said position proximate said module latch when said lever arm is rotated.

2. The SFP connector module of claim 1, wherein said lever arm includes a pair of driving arms pivotally mounted to opposite sides of said housing, said driving arms having upper ends joined by a crossbeam and lower ends connected to said ramp beam.

3. The SFP connector module of claim 1, wherein said ramp beam includes an engagement block having cam ears extending from at least one side thereof, said cam ears receiving therebetween said lever arm.

4. The SFP connector module of claim 1, wherein said ramp beam includes a ramp having an inclined surface configured to be slid between said wall of said housing and a cage latch to separate said cage latch and said module latch.

5. The SFP connector module of claim 1, wherein said lever arm includes driving arms and said housing has guide channels, said driving arms being received and rotatable in said guide channels.

6. The SFP connector module of claim 1, wherein said lever arm includes a crossbeam and driving arms, said lever arm being rotatable in said housing such that when said crossbeam is pulled in a direction away from said housing, said driving arms move said ramp beam against a cage latch and said housing slides away from said cage.

7. The SFP connector module of claim 1, wherein said lever arm includes a driving arm and said ramp beam has a first cam ear, said driving arm engaging said first cam ear to move said ramp beam to disengage a cage latch when said lever arm is rotated to an engagement position, said driving arm engaging said first cam ear to retain said ramp beam to said wall of said housing when said lever arm is rotated to a forward position.

8. The SFP connector module of claim 1, wherein said ramp beam includes a ramp with an inclined surface, said ramp slidably engaging a cage latch such that said inclined surface pushes the cage latch away from said module latch.

9. A connector module configured to join a cage housing having a retention spring extending from a bottom wall of the cage housing, comprising:

a module housing having a ramp beam slidably mounted thereto and having a locking tab projecting from a bottom wall of said module housing, a lever arm rotatably mounted to a longitudinal side wall of said module housing to move said ramp beam; and a cage housing having an open end to receive said module housing, said cage housing including a retention spring extending from a wall of said cage housing, said cage housing receiving said module housing such that said locking tab is received in said retention spring, said lever arm moving said ramp beam to engage said retention spring and release said locking tab from said retention spring.

10. The connector module of claim 9, wherein first and second cam ears extend from said wall of said module housing, said first and second cam ears defining a gap that receives said lever arm such that said lever arm engages either of said first and second cam ears depending on which direction said lever arm is rotated.

11. The connector module of claim 9, wherein said lever arm includes driving arms extending from a crossbeam, said driving arms pushing said ramp beam a first direction when said crossbeam is moved in an opposite second direction.

12. The connector module of claim 9, wherein said module housing includes side walls having post holes and said lever arm has posts, said post holes receiving said posts such that said lever arm is rotatable about said posts.

13. The connector module of claim 9, wherein said module housing includes guide channels and said lever arm includes driving arms that are received and rotatable in said guide channels.

14. The connector module of claim 9, wherein said lever arm includes a crossbeam and driving arms, said lever arm being rotatable in said module housing such that when said crossbeam is pulled in a direction away from said module housing, said driving arms move said ramp beam against said retention spring and said module housing slides away from said cage housing.

15. The connector module of claim 9, wherein first and second cam ears extend from said wall of said module housing, said lever arm includes a driving arm that engages said first cam ear to move said ramp beam to disengage said retention spring when said lever arm is rotated in a first direction and engages said second cam ear to move said ramp beam away from said locking tab when said lever arm is rotated in an opposite second direction.

16. The connector module of claim 9, wherein said ramp beam includes a ramp at a first end and a lever engagement block at an opposite second end that receives said lever arm, said ramp beam being slidably retained to said module housing such that said lever arm engages said lever engagement block to slidably move said ramp to engage said retention spring.

17. A connector assembly comprising:

a module housing having a ramp beam slidably mounted thereto and having a locking tab projecting from a wall bottom of said module housing, a lever arm rotatably mounted to a longitudinal side wall of said module housing to move said ramp beam; and a cage housing having an open end to receive said module housing, said cage housing including a retention spring extending from a wall of said cage housing, said cage housing receiving said module housing such that said locking tab is received in said retention spring, said lever arm moving said ramp beam to engage said retention spring and release said locking tab from said retention spring.

18. The connector assembly of claim 17, wherein said ramp beam has cam ears extending laterally from sides of said ramp beam, said cam ears defining gaps therebetween that receive said lever arm.

19. The connector assembly of claim 17, wherein said lever arm includes driving arms extending from a crossbeam, said driving arms pushing said ramp beam in a first direction when said crossbeam is moved in an opposite second direction.

20. The connector assembly of claim 17, wherein said module housing includes side walls having post holes and said lever arm includes posts, said post holes receiving said posts such that said lever arm is rotatable about said posts.

* * * * *